United States Patent [19]

Zucchini

[11] Patent Number: 4,569,567

[45] Date of Patent: Feb. 11, 1986

[54] COMPUTER TERMINAL CONNECTOR

[76] Inventor: Michael R. Zucchini, 2 Surf Rd., Westport, Conn. 06880

[21] Appl. No.: 609,969

[22] Filed: May 14, 1984

[51] Int. Cl.[4] ..... H01R 13/50

[52] U.S. Cl. ..... 339/154 A; 339/154 R; 339/177 R; 339/156 R; 339/157 R; 339/158

[58] Field of Search ..... 339/153-159, 339/166, 168, 170, 176 R, 176 M, 177 R, 177 E

[56] References Cited

U.S. PATENT DOCUMENTS

| | | | |
|---|---|---|---|
| 2,377,912 | 6/1945 | Way | 339/166 R |
| 2,597,600 | 5/1952 | Shapiro | 339/170 |
| 2,634,345 | 4/1953 | Knight | 339/164 R |
| 2,732,533 | 1/1956 | Andrews et al. | 339/170 |
| 2,911,614 | 11/1959 | Davis | 339/164 R |
| 2,979,624 | 4/1961 | Askerneese | 339/164 R |
| 3,054,024 | 9/1962 | Van Dillen et al. | 339/166 R |
| 3,579,175 | 5/1971 | Shroyer | 339/170 |
| 3,745,511 | 7/1973 | Fussell | 339/90 R |
| 4,451,108 | 5/1984 | Skidmore | 339/154 R |
| 4,493,515 | 1/1985 | Banks | 339/164 M |

FOREIGN PATENT DOCUMENTS

| | | | |
|---|---|---|---|
| 2480512 | 10/1981 | France | 339/154 R |

OTHER PUBLICATIONS

IBM Tech. Disclosure Bulletin, "Wall Mounted Plug in Power Pack", vol. 20, #3, Aug. 1977, p. 1059.

*Primary Examiner*—Gil Weidenfeld

*Assistant Examiner*—David L. Pirlot

*Attorney, Agent, or Firm*—Parmelee, Bollinger & Bramblett

[57] ABSTRACT

Computer terminal devices, especially non-intelligent devices, such as video display terminals, (sometimes called Cathode Ray Tubes), printers and others must be connected to an electrical energy source as well as a coaxial cable which links the terminal device with a cluster terminal control unit which in turn is ultimately connected with a central processor computer. These connections are provided by a combination male plug having a plug housing with a coaxial cable receptacle mounted thereon to be used to accept the coaxial connection from the terminal into the male plug and an AC power line to complete the AC power connection from the terminal to the male plug: therefore, the male plug accomplishes both the coaxial and AC power connections from the terminal to the male plug. Male connector prongs are mounted in the housing of the male plug and are used to complete the connection of coaxial and AC power supply with the female receptacle. A matching combination female receptacle mounted on a receptacle housing is complementary to and is adapted to receive the male connector. The combination female receptacle is provided on each desk or work area where it is coupled to a source of power as well as to a coaxial cable providing a communications line to its associated computer, through a cluster terminal control unit to a communications controller or directly to the host processor.

7 Claims, 12 Drawing Figures

Fig. 4.
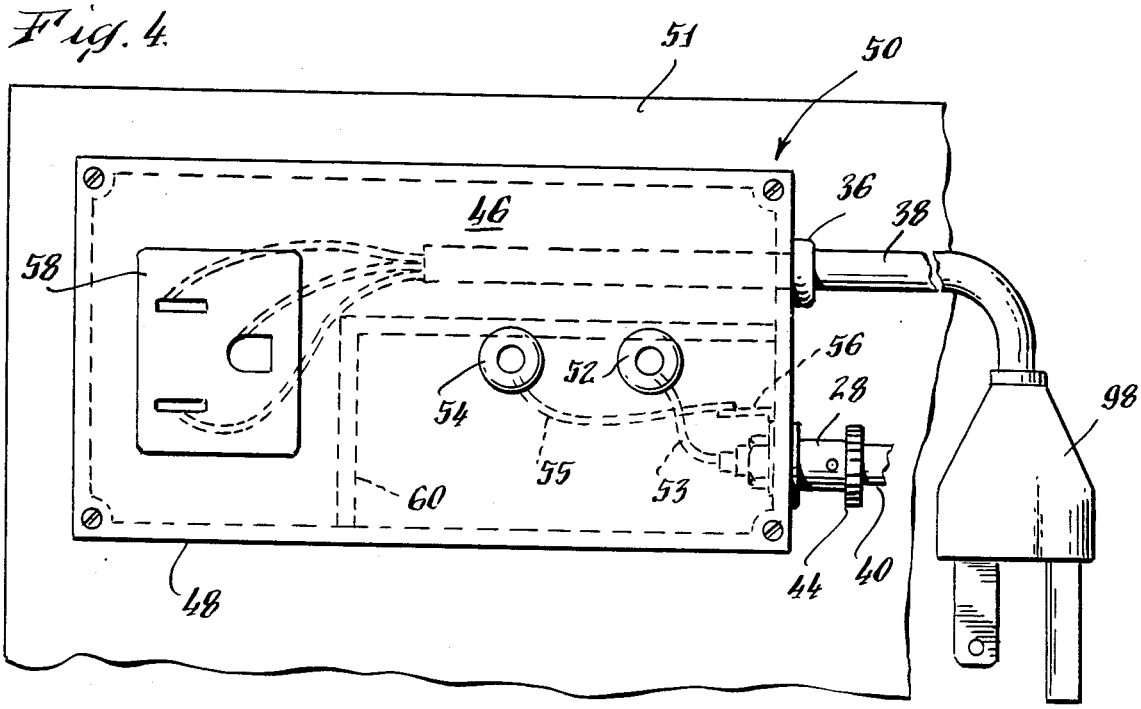
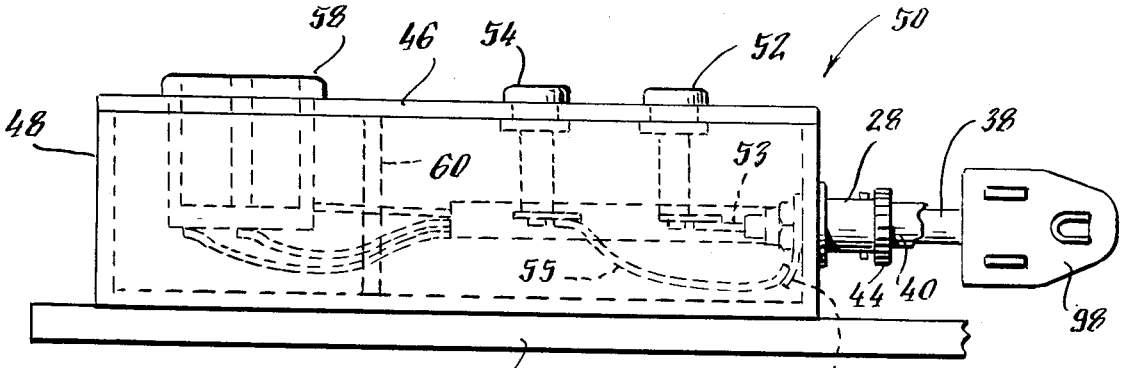
Fig. 5.

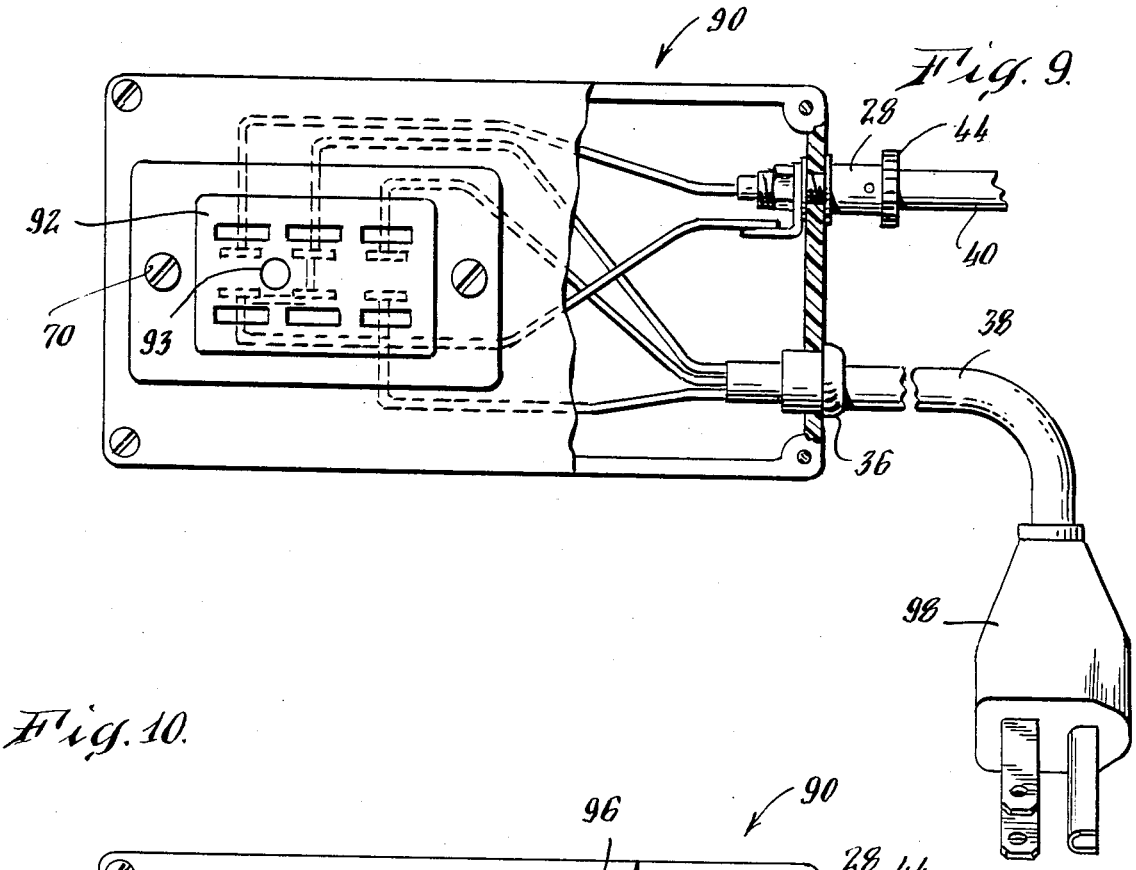
Fig. 9.
Fig. 10.
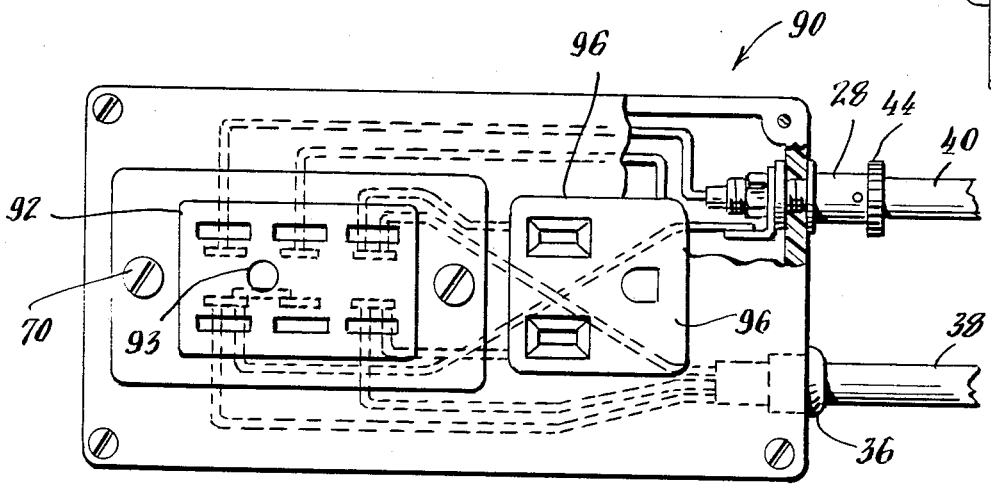
Fig. 11.
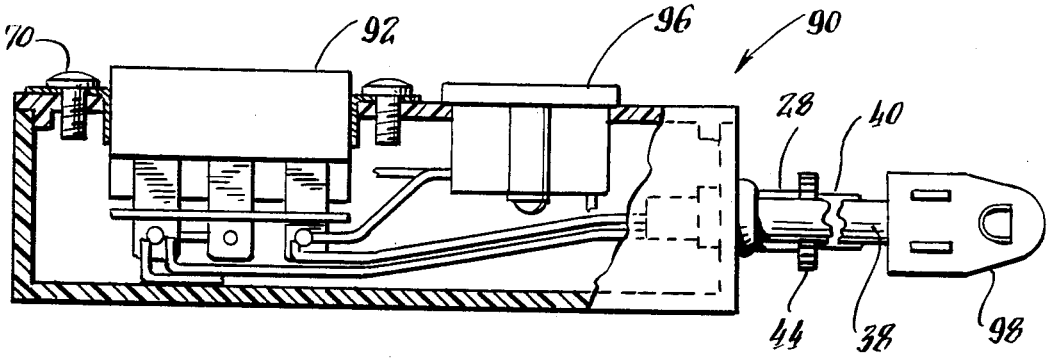

COMPUTER TERMINAL CONNECTOR

BACKGROUND OF THE INVENTION

This invention relates to plug and receptacle electrical connectors, and more particularly, to a combination plug and combination receptacle for coupling computer terminals at a remote location to a cluster terminal control unit.

Access to computers may be had in many locations in the same building, (i.e., LOCAL) or beyond the local capability (REMOTE) such as those separated in different cities requiring interconnecting communication systems such as leased lines, communication satellites, etc. ALL LOCAL or REMOTE stations or satellites have a common denominator which is that they contain computer terminal devices such as video display terminals, printers and other equipment which must be connected to an electrical power source as well as a communication line normally in the form of a coaxial cable which links the terminal device to the cluster terminal control unit, whereupon and varying by local or remote, it is connected to the central processor. The coaxial cable is connected from the terminal to a control unit, for example, an IBM 3274 cluster terminal controller. Ordinarily, the computer terminal devices are permanently connected; that is, plugged into an electrical power outlet in a pre-wired situation, e.g. as a wall outlet, and located such that the power cord is not susceptible to being tripped over. In addition to the power connection, the terminal needs a coaxial cable connection, usually one continuous cable, to the cluster terminal control unit. The cable connection at the terminal end called a BNC Bulk Head Receptacle has a single wire located centrally at the end of the coaxial cable. Disconnecting and reconnecting the coaxial cable at the terminal end is not trouble-free as the wire can easily bend or break. Furthermore, the point at which the coaxial connector connects to a computer terminal device (BNC Bulk Head Receptacle) is usually located in a difficult to reach area such as at the back or near to the bottom of the device and is often embedded in a special concealed compartment.

Using the traditional method of permanently dedicating a terminal at the user's work area for each light to medium activity user requires more terminals than the work load requires. Using the alternative traditional method, that is a common terminal area which is established within a reasonable distance of a group of light to medium activity users is more efficient in the sense that it requires fewer terminals to support the group of targeted users; however, since the common terminal area is away from the individual's work area using the common area is very inconveninent since one loses immediate access to the individuals' work area which may be required in conjunction with the terminal. This is the main reason why, although infrequently used, terminals may be dedicated at each users' area.

Under any circumstances however, either permanently dedicating a terminal for each user or establishing a common area for terminal processing which is pre-wired, may unnecessarily tie-up and require multiple computer terminal equipment which is not fully utilized, or may be inconvenient to the user who doesn't have a permanently attached terminal at his location and must move to a common terminal area, or otherwise gain access to a computer terminal at some other location. Accordingly, in situations where light to medium computer terminal activity is required, it is inefficient to dedicate terminals to each user or to inconveniently establish a common area for terminal processing.

The present invention is directed to the solution of this problem in which the terminals may be moved from one location to another as needed and merely plugged in so that when a user requires the use of computer terminal equipment, the terminal is merely moved to the user's location and plugged in.

SUMMARY OF THE INVENTION

Accordingly, it is an object of this invention to provide a new and improved computer terminal connector which increases the portability and use of computer terminals.

A further object of this invention is to provide a new and improved computer terminal connector apparatus providing for shared use of computer terminal equipment without requiring any additional wiring than would be required in permanently establishing a computer satellite station.

Another object of this invention is to provide a new and improved computer terminal connection apparatus in which the computer terminal equipment may be moved about quickly, efficiently and conveniently merely by unplugging and replugging a single plug at a location from which the equipment is to be moved to a new location where it is to be utilized.

Another object of this invention is to provide a new and improved computer terminal connection apparatus which will be extremely beneficial to situations where the terminal equipment must be shared by more than one person where an individual using the equipment must operate it at or near a specific location during short time periods throughout the day.

Another object of this invention is to provide a new and improved computer terminal connection apparatus which would be extremely beneficial to situations where light to medium activity users require access to computer terminals at their work stations. The improved portability provided by the male and female plug combinations will reduce the number of terminals and associated expenses required to support the light to medium activity user group.

Another object of this invention is to provide a new and improved computer terminal connection apparatus which will be extremely beneficial to situations where an individual requires access to different types of computer terminals at his work area. Various terminal types can be interchanged quickly and efficiently by merely unplugging the unwanted terminal and plugging in the desired terminal.

Another object of this invention is to provide a new and improved computer terminal connection apparatus which will provide a three prong AC female outlet which can be utilized whenever a computer terminal is not in use. The three prong female AC outlet is contained within the combination female receptacle and is available for use whenever a male plug (terminal) is not engaged.

In carrying out this invention in one illustrative embodiment thereof, a combination plug and combination receptacle which provide for coupling computer terminal devices to an electrical energy source as well as a coaxial cable which links the terminal device with a cluster terminal control unit which in turn is ultimately connected with a central processor computer. These connections are provided by a combination male plug having a plug housing with a coaxial cable receptacle mounted thereon to be used to accept the coaxial connection from the terminal into the male plug and an AC power line to complete the AC power connection from the terminal to the male plug; therefore, the male plug accomplishes both the coaxial and AC power connections from the terminal to the male plug. Male connector prongs are mounted in the housing of the male plug and are used to complete the connection of coaxial and AC power supply with the female receptacle. A matching combination female receptacle mounted to a receptacle housing is complementary to and is adapted to receive the male connector.

A combination female receptacle having a receptacle housing positioned at a location where the terminal equipment is desired to be used, is adapted to have an AC power source, and a coaxial cable from a cluster terminal control unit coupled thereto. Means are provided for coupling an AC power source to the receptacle housing. A coaxial cable receptacle is mounted on the combination female receptacle housing which is adapted to receive a coaxial cable communications link to the cluster terminal control unit which in turn is connected to the central processor computer. The combination receptacle has female receptacle means adapted to receive the male connector prongs and the power prongs of said combination male plug whereby the computer terminal to which the plug is attached may be coupled to a cluster terminal control unit by plugging the combination male plug into the combination female receptacle at the locations where the computer terminal equipment is desired to be used.

BRIEF DESCRIPTION OF THE DRAWINGS

The invention, together with further aspects, features, advantages and objects thereof will be more clearly understood from the following description taken in conjunction with the accompanying drawings in which like reference numerals will be utilized to identify like elements throughout the various illustrations.

FIG. 4 is a top view of a complementary combination receptacle adapted to receive the combination plug shown in FIGS. 1–3.

FIG. 5 is a side elevational view of the combination receptacle shown in FIG. 4.

FIG. 9 is a top view with the cover partly broken away of the combination receptacle illustrated in FIG. 8.

FIG. 10 illustrates a top view with the cover partly broken away of a modified version of the combination receptacle illustrated in FIG. 9 which provides an additional power outlet.

FIG. 11 is a side elevation view, partly in cross-section and partly broken away of the combination receptacle illustrated in FIG. 10.

DESCRIPTION OF THE PREFERRED EMBODIMENTS

The present invention is directed to interconnecting computer terminal equipment to a cluster terminal control unit which is connected directly to a central processor computer (Local) or indirectly via a communications controller of a central processor. In order to utilize the terminal equipment the computer terminal connection apparatus of the present invention contemplates a combination plug coupled to the terminal equipment as well as a combination receptacle either permanently or removably mounted at a location where the computer terminal equipment is to be used which is connected to the cluster terminal control unit. The connection apparatus will first be described which involves both providing power to the terminal equipment as well as a communications line to the cluster terminal control unit which is ultimately connected to the central processor computer and then an illustration of the application and use will be described in an illustrative embodiment in FIG. 12.

Figure 1:
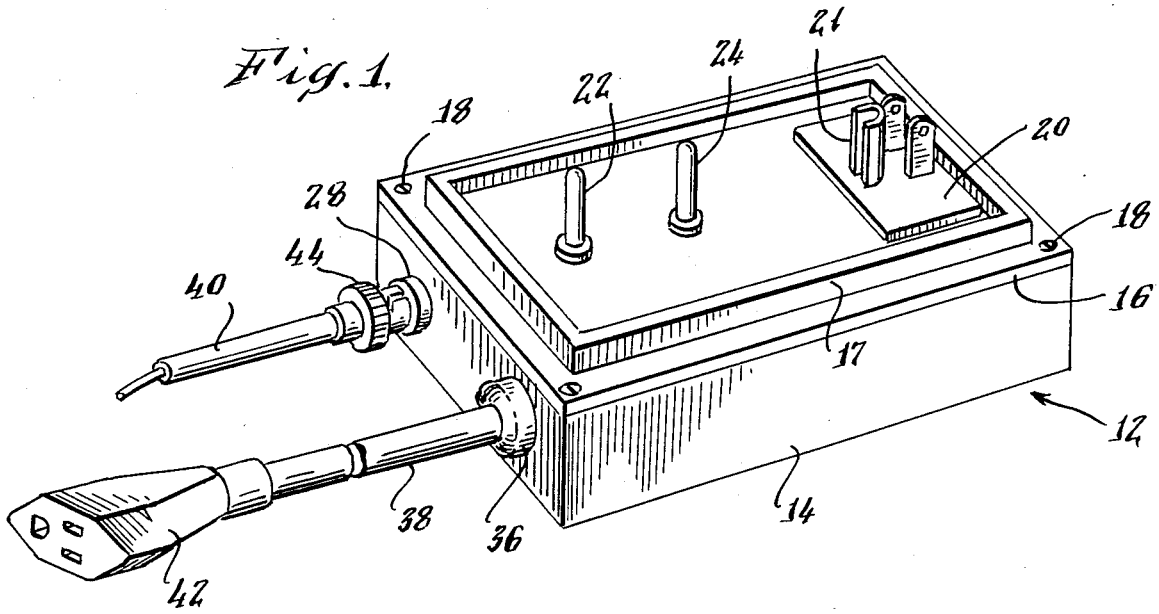
FIG. 1 is a perspective view of one embodiment of a combination male plug forming a part of the computer terminal connection apparatus in accordance with the present invention.
Figure 2:
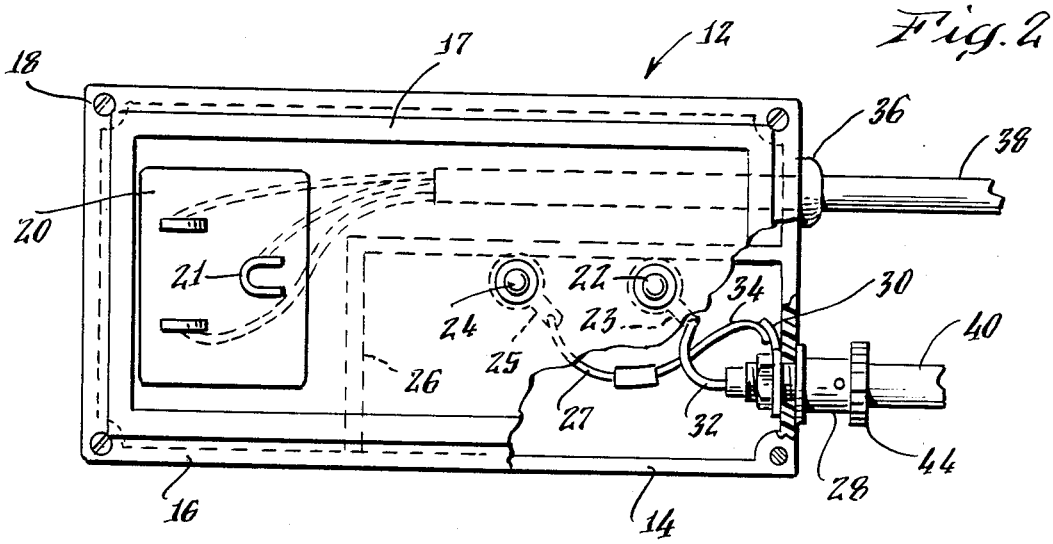
FIG. 2 is a top view of FIG. 1 with the cover of the combination plug partly broken away.
Figure 3:
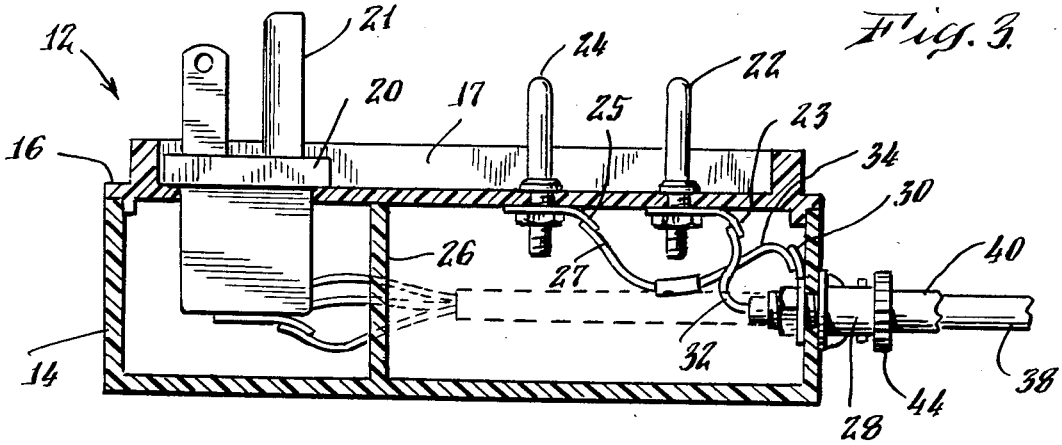
FIG. 3 is a side elevational, partial cross-sectional view of the combination plug shown in FIG. 2.
Figure 12:
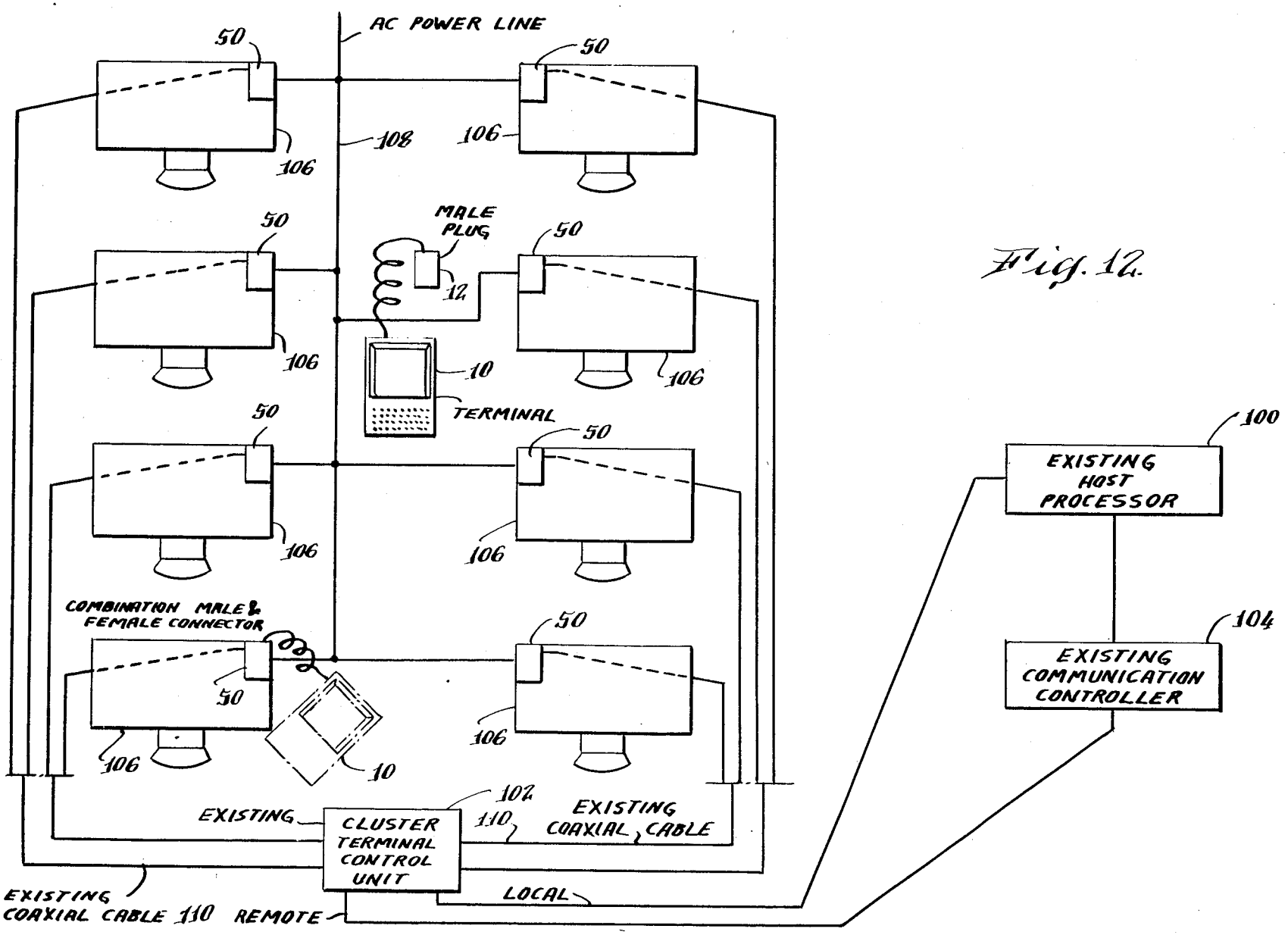
FIG. 12 is a schematic block diagram illustrating the use and applicability of the present computer terminal connection apparatus.

Referring now to FIGS. 1–3, a combination male plug 12 is provided which is adapted to be coupled to a computer terminal 10 (see FIG. 12). The combination male plug 12 has a housing 14 with a cover 16 carrying a cover flange 17 with the cover 16 being mounted on the combination plug housing 14 by screws 18. A three-prong plug 20 having a ground prong 21 is mounted on the cover 16 and has a source of power applied thereto by a three-wire power cord 38 extending through the side of the housing 14 through a strain relief 36. Molded power receptacle 42 (see FIG. 1) may be provided on the power cord 38 so that the combination male plug 12 may be conveniently attached or detached to the computer terminal.

A pair of banana plugs 22 and 24 are also mounted on the cover 16 by chassis mounts 23 and 25, respectively. A BNC bulkhead receptacle 28 is mounted on the housing 16 which is adapted to receive a coaxial cable 40 by a coaxial cable connector 44. The coaxial cable 40 is connected via a ring terminal 30 by a lead 27 to the chassis mount 25 of the banana plug 24 for providing a ground connection to the cable 40. The central connector of the cable 38 or communication line thereof is connected by lead 32 to the chassis mount 23 and accordingly, to the banana plug 22. It will be noted again that preferably, the coaxial cable 40 which leads to the computer terminal 10 may be connected or disconnected from the combination male plug 12 via the coaxial cable terminal 44 and its bulkhead receptacle 28. Making both the coaxial cable and the power cord connectable and disconnectable from the computer terminal 10, is the preferred form, but it will be apparent that the combination plug 12 may be hard wired directly to the computer terminal if so desired.

A separator 26 may be optionally provided in the combination plug housing 14 in order to separate the power cord 38 and its connections to the three-prong plug 20 from the coaxial cable 40 and its connections to the banana plugs 22 and 24. This separation will tend to isolate the two lines and prevent electrical interference from occurring in the communications line provided by the coaxial cable 40. The housing and cover of the combination male plug 12 are preferably of a stiff plastic such as ABS plastic.

FIGS. 4 and 5 show a complementary mating combination female receptacle 50 which is adapted to receive the combination male plug 12 illustrated in FIGS. 1–3. The combination female receptacle 50 has a housing 48 and a cover 46. The cover 46 carries a pair of banana jacks 52 and 54, which are interconnected by leads 53 and 55 to the coaxial cable 40 via a ring terminal 56 and a BNC bulkhead receptacle 28. The lid 46 also carries a three-prong receptacle 58 which is coupled to a three-wire power cord 38. Again, the separator 60 may be utilized to separate the power cord from the coaxial cable to prevent interference.

The receptacle in FIGS. 4 and 5 is adapted to be connected to a power line by a male plug 98 as well as a communications line through a coaxial cable 40 and BNC plug 44 to a cluster terminal control unit then to a communications controller or directly to a central processor. Accordingly, when the mating combination plug illustrated in FIGS. 1–3 is plugged into the receptacle of the type illustrated in FIGS. 4–5, a computer terminal is provided with both power and a communications line in order to function properly. The receptacle 50 is provided with an optional mounting plate 51 which may be used to fasten the receptacle to a surface, e.g., desk or left unattached and used as a handling aid to facilitate plugging and unplugging of a male plug e.g. plug 20.

Figure 6:
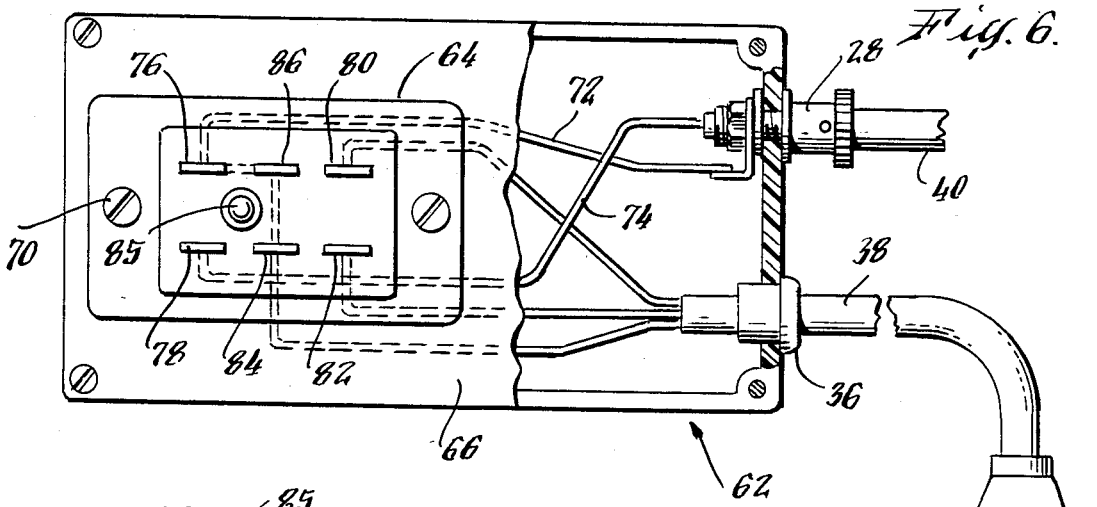
FIG. 6 is the top view with the cover partly broken away illustrating another embodiment of a combination plug forming an element of the computer terminal connection apparatus embodied in the present invention.
Figure 7:
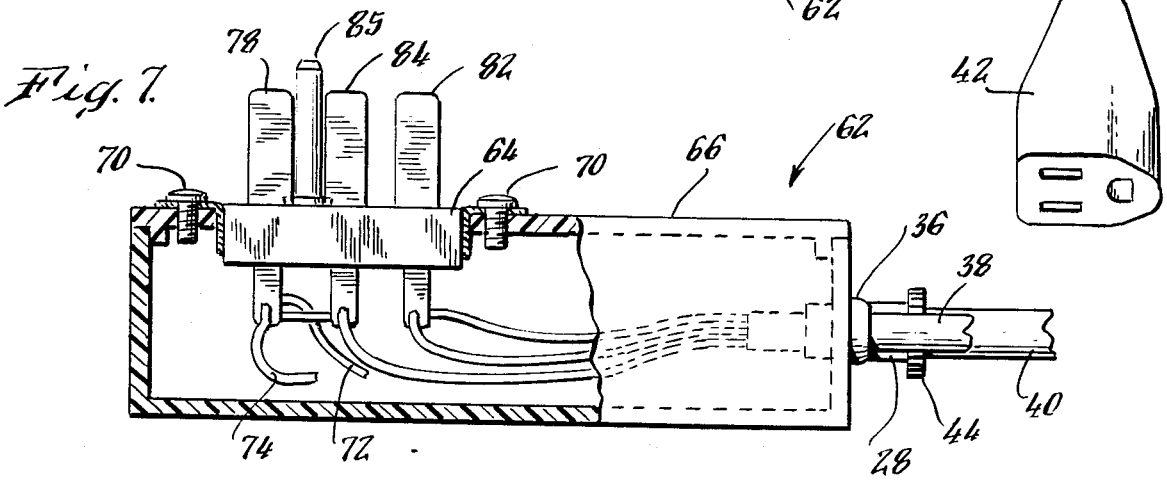
FIG. 7 is a side elevational view partly broken away and partly in section of the combination plug illustrated in FIG. 6.

In the embodiment of FIGS. 6–7, a combination male plug 62 is provided in which a six-prong plug 64 with guidepost 85 is mounted on the cover 66 of the housing 68 by screws 70. The six-prong plug 64 with guidepost 85 has both the coaxial cable 40 and power cord 38 connections made thereto. As will be seen in FIG. 6, the coaxial ground 72 and the coaxial current 74 interconnect the BNC bulkhead receptacle 28 on which the coaxial cable 40 and BNC plug 44 are positioned to prongs 76 and 78. The power cord 38 is connected to power prongs 80 and 82 with the ground lead going to prong 84 which is interconnected with prongs 76 and 86 as will be seen in FIG. 7. Prongs 76 and 84 are interconnected providing a common ground connection for both the coaxial cable 40 as well as the power cord 38. As in the previous embodiments, the combination male plug 62 is preferably connectable and disconnectable from the computer terminal 10 and accordingly, a molded power receptacle 42 is shown attached to the power cord 38. As in previous embodiments, the BNC bulkhead receptacle 28 is adapted to receive a coaxial cable 40 and BNC plug 44 in order to connect the coaxial cable to the male power plug 62.

Figure 8:
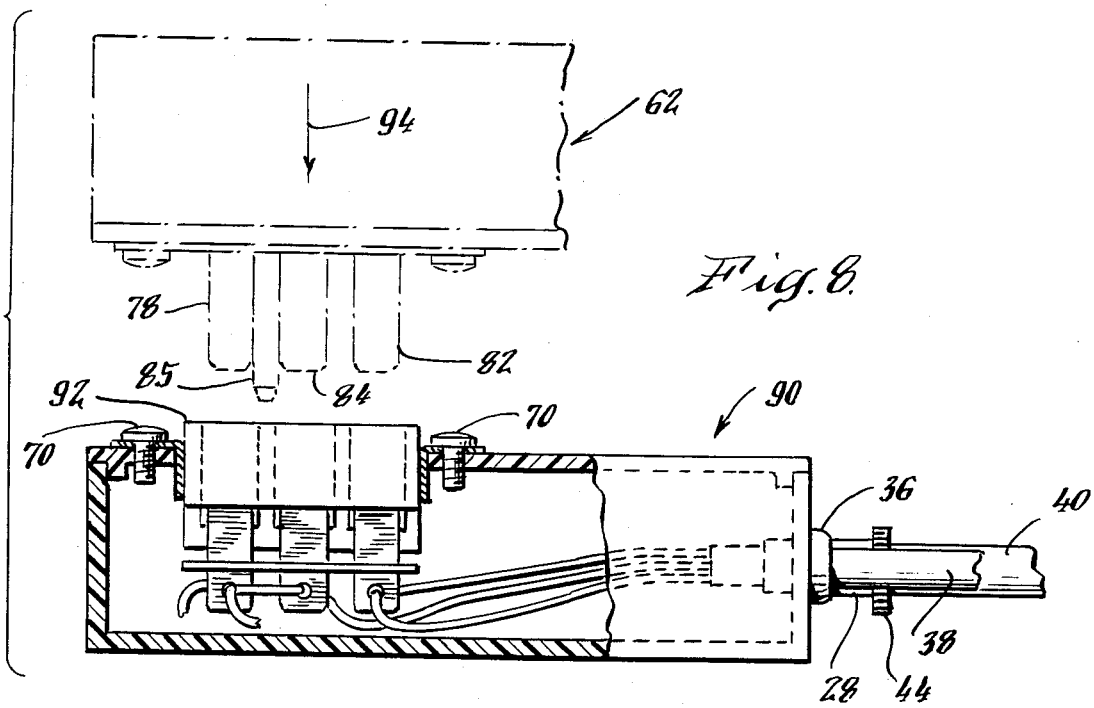
FIG. 8 is a side elevational view partly in cross-section and partly broken away of a complementary receptacle for the combination plug illustrated in FIGS. 6 and 7 showing such a plug in phantom, and illustrating the direction of its insertion into the receptacle shown in FIG. 8.

FIGS. 8 and 9 show the complementary combination female receptacle 90 which is adapted to receive the combination male plug 62 illustrated in FIGS. 6–7. The combination female receptacle 90 includes a unitary six-prong plug 92 with guidehole 93 receptacle for receiving the six prongs 64 and guidepost 85 of the combination male plug 62. The alignment and mating arrangement is illustrated in phantom by the combination male plug 62 being inserted in the direction of the arrow 94 illustrated in FIG. 8. Again, as in the other embodiments, the combination female receptacle 90 is adapted to be connected to a communications line of the cluster terminal control unit as well as a source of power. Accordingly, plugging the combination male plug 62 which is attached to the computer terminal into the combination female receptacle 90 will provide both the power and the interconnection to the cluster terminal control unit which is ultimately connected to the central computer in order to operate the computer terminal 10. The receptacle 90 may be provided with the optional mounting plate 51 (FIG. 4).

FIGS. 10 and 11 illustrate an alternative embodiment with respect to the combination female receptacle 90 illustrated in FIGS. 8 and 9. In this embodiment, in addition to the six-prong receptacle 92 with guidehole 93, an additional three-prong receptacle 96 is mounted to the combination female receptacle 90 with the three-prong receptacle 96 being coupled in parallel to the power receptacle terminals of the female receptacle 92. The purpose of the three-prong receptacle 96 is to provide an extra electrical outlet so that the receptacle 90 can provide power at that location for another appliance or auxiliary computer equipment when the male plug is not in use. As in the case with the other embodiments, a molded three-prong power plug 98 is provided for providing power to the receptacle 90.

FIG. 12 illustrates one way of employing the computer terminal connection apparatus embodied in the present invention. The computer or central processor 100 may be connected directly to a cluster terminal control unit 102, or through a communication controller 104 to the control unit 102. A plurality of desk locations 106 are provided which are desired to be provided with a computer terminal capability. In accordance with the present invention, each desk is equipped with a combination female receptacle 50, 90, or 96 which are coupled to an AC power line 108 and an existing coaxial cable 110. Accordingly, a computer terminal carrying the combination male plug 12 or combination male plug 62 chosen to match the type of combination female receptacle which has been installed, permits the terminal 10 to be plugged in at any of the separate desk locations 106. As illustrated in FIG. 12, two terminal units may service any desk area. The computer terminals are simply placed on a cart and moved to the desk where desired and plugged in.

Prior to this approach there were only two traditional methods for providing terminal access to individuals who require light to medium terminal activity. The first traditional method is permanently dedicating a terminal at the user's work area for each light to medium activity user which requires more terminals than the work load requires. Using the second alternative traditional method, that is a common terminal area which is established within a reasonable distance of a group of light to medium activity users is more efficient in the sense that it requires fewer terminals to support the group of targeted users; however, since the common terminal area is away from the individiuals' work area using the common area is very inconvenient since one loses immediate access to the individual's work area which may be required in conjunction with the terminal. This is the main reason why, although infrequently used, terminals may be dedicated at each users area. In accordance with the Applicant's invention, the computer terminal connection apparatus is utilized for providing each desk or work area with a combination female plug to accommodate the movement and plugging in of a computer terminal apparatus right at that desk or work area. The computer terminals can be wheeled to the desk on mobile carts with the terminal being plugged in at the desired work location. Accordingly, each individual has the convenience of a computer terminal device at his or her work station greatly increasing the efficiency of the operation and limiting the number of terminals and associated expenses required to process a large number of individuals.

The Applicant's computer terminal connection apparatus allows a quick connect and disconnect for both the AC power supply as well as the coaxial cable connection in one operation by simply inserting the combination male plug into the female connector. Without this arrangement, the process would be slow, cumbersome and impractical especially in an environment where terminals must be connected and disconnected and shared throughout the day, not to mention the possibility of damage to the connections as well as a possible damage or hazard to the people attempting to make the connections.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A plug and receptacle for coupling computer terminals to a cluster terminal control unit comprising:

a combination male plug having a plug housing adapted to provide connections to an AC power source and a coaxial cable for a computer terminal, a coaxial cable receptacle mounted on said plug housing adapted to have a coaxial cable from a computer terminal coupled thereto, a pair of male connector prongs mounted on and extending from the same side of said plug housing, said male connector prongs coupled in said plug housing to said coaxial cable receptacle, means for coupling an AC power source to said plug housing, a power plug coupled to said AC power source in said plug housing having power prongs mounted in said housing and extending out of said housing from the same side of said housing as said male connector prongs, a combination female receptacle having a receptacle housing adapted for coupling an AC power source and a coaxial cable from a cluster terminal control unit to said combination female receptacle, means for coupling an AC power source to said receptacle housing, a coaxial cable receptacle mounted on said combination female receptacle housing adatped to receive a coaxial cable communication line from a cluster terminal control unit, said combination receptacle having female receptacle means adapted to receive said pair of male connector prongs and said power prongs of said combination male plug, whereby a computer terminal carrying said combination male plug may be coupled to a cluster terminal control unit by plugging said combination male plug into said combination female receptacle at desired locations from said cluster terminal control unit.

2. The plug and receptacle as claimed in claim 1 in which said pair of male connector prongs are prongs and said combination female receptacle has a pair of jacks adapted to receive said prongs while said combination plug is plugged into said combination receptacle.

3. The plug and receptacle as claimed in claim 1 in which said pair of male connector prongs and said male power prongs are incorporated in a single plug mounted in said housing.

4. The plug and receptacle as claimed in claim 3 in which said receptacle comprises a single receptacle having female connectors for receiving the male prongs and alignment post of said single plug.

5. The plug and receptacle as claimed in claim 3 in which said power prongs include an alignment post and said single plug has a total of six prongs in addition to said alignment post and means for interconnecting three of said prongs thereby providing a common ground connection for the power plug and said coaxial cable.

6. The plug and receptacle as claimed in claim 1 in which said female receptacle has a single receptacle mounted in said receptacle housing with six openings and an alignment opening therein which are adapted to receive said six prongs and said alignment post of said single male plug in said combination male plug.

7. The plug and receptacle as claimed in claim 5 in which said female receptacle has a first receptacle mounted in said receptacle housing with six openings and an alignment opening therein which are adapted to receive the six prongs and alignment post of said single plug in said combination male plug, a second three-prong receptacle mounted in said receptacle housing interconnected in parallel with the power receptacle means in said first receptacle to provide an additional power outlet in said female receptacle.

* * * * *